US005159619A

United States Patent [19]

Benz et al.

[11] Patent Number: 5,159,619

[45] Date of Patent: Oct. 27, 1992

[54] HIGH PERFORMANCE METAL X-RAY TUBE TARGET HAVING A REACTIVE BARRIER LAYER

[75] Inventors: Mark G. Benz, Burnt Hills; Melvin R. Jackson, Schenectady; Robert J. Zabala, Schenectady; Karen A. Lou, Schenectady, all of N.Y.; Thomas C. Tiearney, Jr., Waukesha, Wis.

[73] Assignee: General Electric Company, Schenectady, N.Y.

[21] Appl. No.: 760,262

[22] Filed: Sep. 16, 1991

[51] Int. Cl.[5] ..... H01J 35/08

[52] U.S. Cl. ..... 378/143; 378/144; 378/127; 378/129

[58] Field of Search ..... 378/143, 119, 129, 127, 378/144

[56] References Cited

U.S. PATENT DOCUMENTS

| | | | |
|---|---|---|---|
| 4,331,902 | 5/1982 | Magendans et al. | 378/144 |
| 4,335,327 | 6/1982 | Waugh et al. | 378/129 |
| 4,516,255 | 5/1985 | Petter et al. | 378/143 |
| 4,975,621 | 12/1990 | Fukubayashi et al. | 378/129 |

*Primary Examiner*—Constantine Hannaher
*Assistant Examiner*—Kim-Kwok Chu
*Attorney, Agent, or Firm*—James Magee, Jr.

[57] ABSTRACT

A high performance x-ray tube rotating target having a reactive barier layer between the substrate and the emissive coating and, if desired, a protective layer of molybdenum between the reactive barrier and the emissive coating is disclosed.

10 Claims, 2 Drawing Sheets

HIGH PERFORMANCE METAL X-RAY TUBE TARGET HAVING A REACTIVE BARRIER LAYER

BACKGROUND OF THE INVENTION

The present invention relates to x-ray tubes and in particular to high performance targets for use in x-ray generating equipment. More particularly, the invention is directed to high performance rotating x-ray tube anode structures which reduces the loss of vacuum caused by gas formation during operation.

The use of metal targets to receive a stream of high energy electrons and to emit x-rays as a result of electron impact on the metal target has been known for many years. As this art has evolved, the targets subjected to electron bombardment to generate x-rays have had to operate at higher and higher temperatures. The development of CAT scan equipment has accelerated this demand for higher and higher operating temperatures for such targets. This is mainly because of the higher current of electrons striking the metal surface and also the frequency of electron impact on the target.

In general, the modern high performance metal x-ray tube target is a rotating anode which has three main functional parts. These are the focal track on which the electrons impact; the substrate on which the focal track is carried; and an emissive coating on the substrate.

The focal track is the area on the front face of the target towards which the electron beam is directed and which absorbs the electrons and generates the x-rays. Heat is also generated as the electrons are absorbed and the x-rays are generated. This region is commonly made up of a tungsten alloy. A powder metallurgy process is employed in forming the focal track region and this process consists of sintering, forging, and heat treating. The density of the metal of the focal track is commonly about 94% of theoretical density.

The alloy substrate beneath the focal track constitutes the bulk of the target mass. The substrate supports the focal track on its front face. The substrate takes up the heat generated in the focal track and dissipates this heat. The alloy substrate is commonly made up of molybdenum alloyed with titanium, zirconium, and carbon. It is coprocessed with the focal track alloy through the sintering, forging, and heat treating steps. An alloy which is currently preferred for this purpose has the nominal composition after processing comprising about 0.5 atom percent titanium, about 0.08 atom percent zirconium, about 250 ppm carbon and the balance molybdenum.

A thermal emittance enhancing coating is applied to the back and sides of the rotating anode to increase heat dissipation by radiation. A variety of such coatings are known. For example, U.S. Pat. No. 4,132,916 describes coatings composed of zirconium dioxide, hafnium oxide, magnesium oxide, strontium oxide, cerium dioxide and lanthanum oxide or mixtures thereof. U.S. Pat. Nos. 4,953,190; 4,029,828; and 4,090,103 also disclose emissive coatings on x-ray targets. Such coatings are generally applied by known methods such as plasma spraying followed by a vacuum or low pressure heat treatment to remove gas trapped or generated during the processing.

One of the problems which has developed in connection with the operation of high performance x-ray tubes is that the increase in the energy input demands on the target has resulted in alloy substrate bulk temperatures which have increased dramatically. At present, peak substrate temperatures reach 1300° C. to 1500° C. At these temperatures, a new problem has developed, namely the generation of gaseous reaction products within the vacuum tube. It is, of course, well known that x-ray equipment operates in a vacuum and that sustaining the vacuum is necessary in order to have a desirable and optimum operation of the x-ray tube itself.

BRIEF STATEMENT OF THE INVENTION

It is, accordingly, one object of the present invention to overcome the problem of gas formation within the vacuum environment of the high performance x-ray tube.

Another object is to provide an x-ray tube capable of operating with high performance and at high temperatures without loss of the desirable high vacuum maintained within the enclosure for the x-ray source.

Another object of the invention is to provide methods and means for substantially preventing undesirable chemical reactions in x-ray tubes.

In one of its broader aspects, the objects of the present invention can be achieved by reducing the formation of carbon monoxide within the tube. This is accomplished by introducing a reactive barrier layer between the molybdenum alloy substrate and the emissive coating deposited over the substrate. The barrier layer functions to reduce gas formation by forming non-gaseous reaction products.

These and other related objects are achieved by an x-ray tube anode comprising a body having a focal track region for impingement by electrons to produce x-rays, a coating distinct from said region for enhancing heat emittance from the body, a reactive barrier layer interposed between the body and the heat emissive coating.

In another embodiment, the invention comprises an x-ray tube anode comprising a body having a substrate, a focal track region on the front of the substrate for impingement by electrons to produce x-rays, a coating distinct from said region for enhancing heat emittance from the body, a reactive barrier layer interposed between the substrate and the heat emissive coating and if desired, a second protective overcoat or layer between the barrier and the emissive coating.

BRIEF DESCRIPTION OF THE DRAWINGS

The detailed descriptions which follow will be understood with greater clarity if reference is made to the accompanying drawings in which.

DETAILED DESCRIPTION OF THE INVENTION

Figure 1:
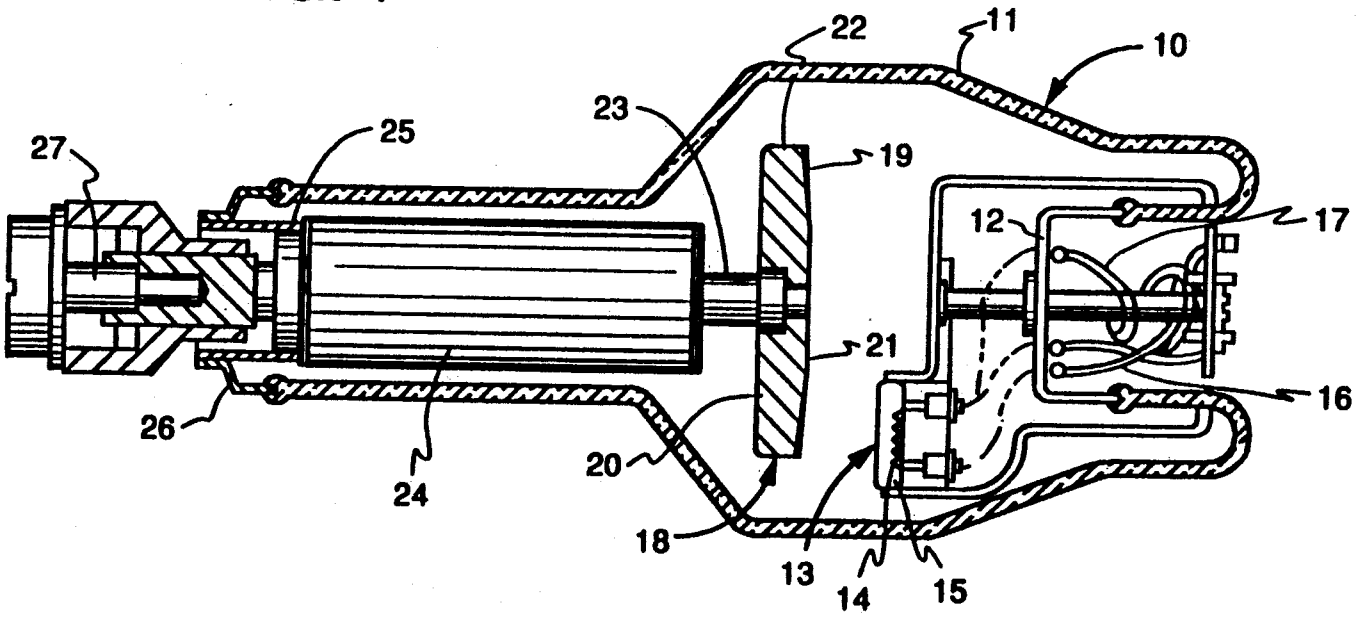
FIG. 1 is a typical rotating anode x-ray tube, shown in section, in which the barrier coating of this invention may be employed.

The high performance x-ray tubes with which this invention is concerned contain a rotating target or anode which has three principal functional regions or parts: the focal track, the substrate, and the emissive coating.

The focal track is the area on the front or face of the target that absorbs electrons and generates x-rays and heat. The focal track is generally a tungsten alloy containing 5 to 10 percent rhenium and is prepared by a powder metallurgy process which includes pressing, sintering, forging, and heat treating.

The substrate forms the bulk of the target mass. The substrate supports the focal track on its front face and absorbs the heat generated in the focal track. The substrate also dissipates the heat through the emissive coating carried on the back and sides of the target. The substrate is an alloy of molybdenum containing titanium, zirconium, and carbon. The substrate is coprocessed with the focal track through the pressing, sintering, forging, and heat treating steps.

The emissive coating is carried on the sides and back of the substrate and functions to increase emissivity and thereby enhance dissipation of heat from the target. This region or coating typically comprises oxides of aluminum, titanium, and zirconium. It is applied to the substrate portion of the finished target by plasma spraying, followed by a vacuum heat treatment. The vacuum heat treatment maximizes emissivity and minimizes entrapment of gases in the coating. The eventual release of such gases during operation of the x-ray tube would compromise the vacuum environment within the tube.

Similarly, chemical reactions between components of the target regions also compromise the vacuum if the reactions lead to the formation of gaseous reaction products directly or indirectly.

It has been found that such reactions can occur between a carbon source in the substrate and an oxygen source in the emissive coating with the resulting formation of carbon monoxide gas.

The reaction can be substantially inhibited by a reactive barrier layer or coating placed between the substrate and the emissive coating. The reactive barrier coating is an alloy of molybdenum or niobium containing a small but effective amount of an alloyed metal or solute which can react with carbon diffusing out of the substrate alloy to form a nongaseous carbide, thus preventing the formation of carbon monoxide. Suitable reactive solute materials include hafnium, zirconium, titanium, tantalum and niobium. Hafnium and zirconium are preferred and these metals individually or in admixture, in a molybdenum base alloy, are preferred combinations. The use of such reactive barrier coating provides a method for substantially preventing carbon monoxide formation within the x-ray tube during use.

The amount of reactive metal atoms in the alloy can range from about 1 to about 20 atom percent. Amounts of about 5 to 20 atom percent are preferred effective amounts.

In general, effective reactive barrier layers can be applied to the substrate prior to application of the emissive coating by conventional processing such as low pressure plasma spraying. Coatings having a thickness of from about 5 to 30 mils have been found effective. At the lower limit, it is necessary to provide sufficient reactive species to react with the amount of carbon diffusing from the substrate alloy. At the upper end, thickness is limited by the tendency for thick coatings to spall off thus reducing the effectiveness of the entire tube. A reactive barrier between about 10 to 20 mils is preferred.

The means and methods of this invention will be more easily understood when considered in conjunction with the drawings.

In FIG. 1, an illustrative x-ray tube generally 10 comprises a glass envelope 11 which has a cathode support 12 sealed into one end. A cathode structure 13 comprising an electron emissive filament 14 and a focusing cup 15 is mounted to support 12. There are a pair of conductors 16 for supplying heating current to the filament and another conductor 17 for maintaining the cathode at ground or negative potential relative to the target of the tube.

The anode or target 18 carries a focal track on which the electron beam from cathode 13 impinges to produce x-radiation. Target 18 is usually made of a refractory metal such as molybdenum or tungsten or alloys thereof but in tubes having the highest rating the target is usually tungsten on a molybdenum alloy substrate. A surface layer or focal track on which the electron beam impinges while the target is rotating to produce x-rays is shown at 19 and is shown in cross section in FIGS. 2 and 3.

The heat emissive coating 20 is shown on the rear surface of target 18, one of the surfaces on which the high thermal emissive coating can be applied. If desired, a concave or convex surface could be employed. The coating may also be applied to areas of the target outside of the focal spot track such as the front surface 21 and the peripheral surface 22 of the target.

The target 18 is fixed on a shaft 23 which extends from a rotor 24. The rotor is journaled on an internal bearing support 25 which is, in turn, supported from a ferrule 26 that is sealed into the end of the glass tube envelope 11. The stator coils for driving rotor 24 such as an induction motor are omitted from the drawing. High voltage is supplied to the anode structure and target 18 by a supply line, not shown, coupled with a connector 27.

As is well known, rotary anode x-ray tubes are usually enclosed within a casing, not shown, which has spaced apart walls between which oil is circulated to carry away the heat that is radiated from rotating target 18. The bulk temperature of the target often reaches 1350° C. during tube operation and most of this heat has to be dissipated by radiation through the vacuum within tube envelope 11 to the oil in the tube casing which may be passed through a heat exchanger, not shown. It is common to coat the rotor 24 with a textured material such as titanium dioxide to increase thermal emittance and thereby prevent the bearings which support the rotor from becoming overheated. If the heat storage capacity of the target 18 is not great enough or if its cooling rate is low, duty cycles must be shortened which means that the tube must be kept deenergized until the target reaches a safe temperature. This often extends the time required for an x-ray diagnostic sequence. Hence, it is important that the emittance of the target surfaces be maximized.

Figure 2:
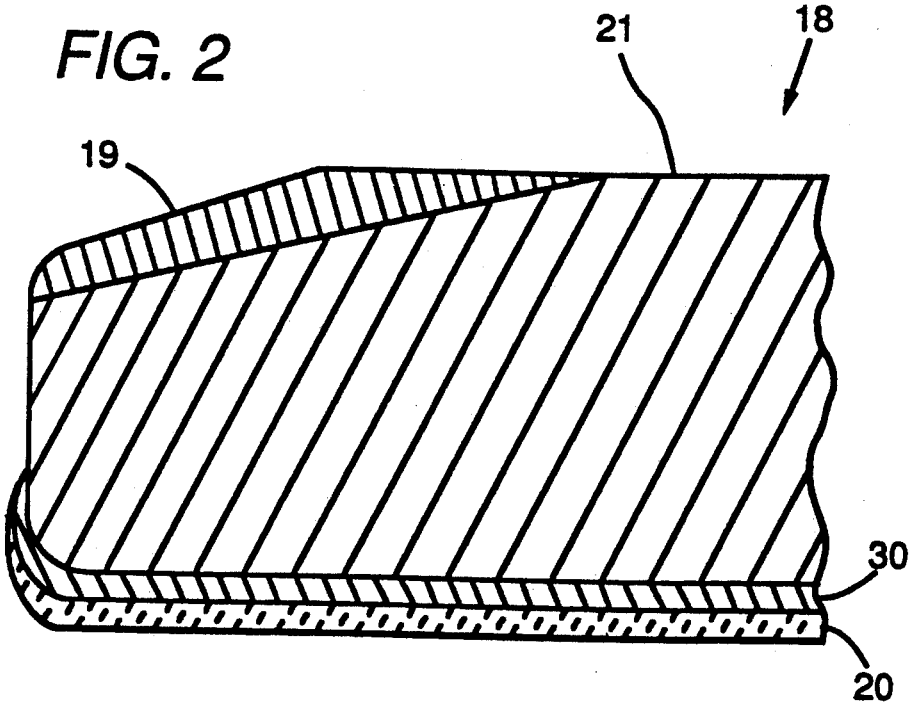
FIG. 2 is a partial sectional view of an anode having a reactive barrier layer.

FIG. 2 shows an anode 18 which is provided with a heat emissive layer 20 of suitable oxides carried on the back and part of the sides of the anode structure. The focal track 19 is shown at the front of the anode 18 and the substrate is shown as the bulk of the anode mass. Reactive barrier layer 30 is placed between the oxide-containing emissive layer and the substrate of anode 18. It has been previously disclosed that the substrate is a carbon-containing refractory alloy, e.g., an alloy of molybdenum. The reactive barrier layer can be comprised of any metal or alloy which contains components which will react with carbon contained in the substrates. It is believed that the presence of the reactive material reduces the activity of the carbon at the barrier-emissive coating interface thus lowering the partial pressure of carbon monoxide in the vacuum tube envelope. The preferred reactive materials for incorporation in the reactive barrier layer include molybdenum and molybdenum alloys that include zirconium or hafnium.

The reactive barrier can be applied by any process compatible with the metallurgy of the substrate and the focal track. Plasma spray deposited barrier layers have been applied by low pressure and by air plasma spraying. In general, the thickness of the barrier layer can range from about 0.005 to about 0.03 inch.

Illustrative compositions of suitable reactive barriers include molybdenum base or niobium base alloys containing from about 1 to about 20 atom percent of a metal selected from the group consisting of titanium, tantalum, niobium, zirconium, or hafnium.

In order to preserve the optical clarity of the x-ray tube envelope, it has been found beneficial to provide the target or anode with an additional protective layer interposed between the reactive barrier layer and the heat emissive oxide coating.

Figure 3:
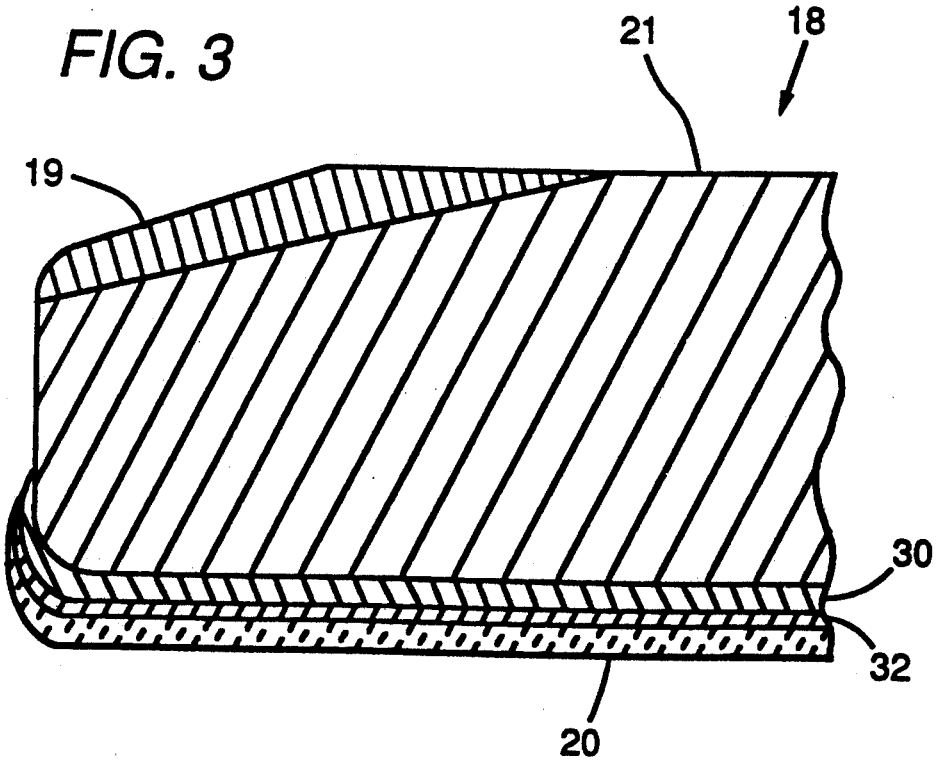
FIG. 3 is similar view of the anode provided with an additional protective layer between the barrier layer and the emissive coating.

FIG. 3 depicts an anode according to this embodiment of the invention. Since the reactive barrier functions through a reduction reaction mechanism in which the active material of the reactive barrier reacts to form hafnium or zirconium carbide. The anode 18 is provided with a focal track 19, an emissive coating 20, reactive barrier layer 30 and a protective layer 32 which physically separates the emissive coating from the reactive barrier layer. This protective layer can be quite thin. It has been found that metals such as hafnium, zirconium, and niobium reduce titanium dioxide in the emissive coating leaving free titanium which vaporizes at the operating temperature of the x-ray tube and migrates out of the target structure and deposits on the inside of the tube envelope.

The reactive barrier is designed to intercept and react with the carbon diffusing from the alloy of which the substrate is made to form a nonvolatile carbide. Any excess of reactive metal such as hafnium or zirconium can reduce titanium oxide which is one of the oxides in the emissive coating, leaving free titanium, which at the operating temperatures of the x-ray tube evaporates and subsequently deposits as metallic titanium on the colder portions of the system such as the glass envelope of the tube.

It has further been found that a protective layer of substantially carbon-free molybdenum placed between the reactive barrier layer and the emissive coating markedly reduces the evolution of titanium. This layer prevents direct contact between the reactive species on the barrier coating and the titanium oxide of the emissive coating. It is also possible to use up any excess reactive metal atoms by including an amount of carbon in the reactive barrier alloy. The amount necessary can be calculated by empirical formulas.

What is claimed is:

1. An x-ray tube anode comprising a body having a focal track region for impingement by electrons to produce x-rays, a coating distinct from said region for enhancing heat emittance from the body, a reactive barrier layer interposed between the body and the heat emissive coating said reactive barrier layer comprising a molybdenum or niobium base alloy containing from about 1 to about 20 atom percent of a metal selected from the group consisting of titanium, niobium, hafnium, zirconium, tungsten and tantalum.

2. An x-ray tube anode of claim 1 comprises a body having a molybdenum alloy substrate, a focal track region on the front of the substrate for impingement by electrons to produce x-rays, a coating distinct from said region for enhancing heat emittance from the body, a reactive barrier layer interposed between the substrate and the heat emissive coating.

3. The anode of claim 2 wherein the substrate alloy comprises about 0.05 atom percent titanium, about 0.08 atom percent zirconium, up to about 250 parts per million carbon, and the balance substantially molybdenum.

4. The anode of claim 3 in which the reactive barrier is from about 0.005 to about 0.030 inch thick.

5. An x-ray tube anode comprising a body having a substrate, a focal track region on the front of the substrate for impingement by electrons to produce x-rays, a coating distinct from said region for enhancing heat emittance from the body, a reactive barrier layer interposed between the substrate and the heat emissive coating, and a protective layer interposed between the reactive barrier layer and the heat emissive coating.

6. The anode according to claim 5 wherein the protective layer is an alloy comprising from about 1 to about 20 atom percent of a member selected from the group consisting of zirconium and hafnium, the balance being substantially molybdenum.

7. A method for stabilizing performance of rotating target x-ray tubes which includes a rotating anode target comprising a molybdenum alloy substrate comprising about 0.05 atom percent titanium, about 0.08 atom percent zirconium, up to about 250 parts per million carbon, and the balance molybdenum, a focal track, and a heat emissive coating which comprises placing a reactive barrier layer between the substrate and the emissive coating and a protective layer of substantially carbon-free molybdenum between the reactive barrier layer and the emissive coating.

8. A method according to claim 7 wherein the reactive barrier layer is comprised of a molybdenum or niobium base alloy alloyed with from about 1 to about 20 atom percent of a metal selected from the group consisting of zirconium, hafnium, titanium, niobium, and tantalum.

9. The method according to claim 7 wherein the reactive barrier layer is from about 1 to about 30 mils thick and comprises an alloy comprising a base metal selected from the group consisting of molybdenum and niobium and from about 5 to about 20 atom percent of a metal selected from the group consisting of hafnium and zirconium.

10. A method for substantially inhibiting formation of carbon monoxide in an x-ray tube having a rotating anode target comprising a carbon-containing alloy substrate, an oxide-containing emissive coating, and a focal track which comprises providing a reactive barrier layer between the emissive coating and the substrate, the reactive barrier layer being molybdenum or niobium alloy comprising from about 5 to about 20 atom percent of a metal selected from the group consisting of hafnium, zirconium, tantalum, titanium, and niobium.

* * * * *